US009469103B2

(12) United States Patent
Shimoda

(10) Patent No.: US 9,469,103 B2
(45) Date of Patent: Oct. 18, 2016

(54) INKJET PRINTER

(71) Applicant: RISO KAGAKU CORPORATION, Tokyo (JP)

(72) Inventor: Asayo Shimoda, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/312,135

(22) Filed: Jun. 23, 2014

(65) Prior Publication Data

US 2014/0375713 A1 Dec. 25, 2014

(30) Foreign Application Priority Data

Jun. 24, 2013 (JP) ..... 2013-131395

(51) Int. Cl.
*B41J 2/045* (2006.01)
*B41J 29/38* (2006.01)

(52) U.S. Cl.
CPC ..... *B41J 2/04573* (2013.01); *B41J 2/04516* (2013.01); *B41J 2/04551* (2013.01); *B41J 2/04563* (2013.01); *B41J 2/04581* (2013.01); *B41J 2/04588* (2013.01)

(58) Field of Classification Search
CPC ..... B41J 2/04516
USPC ..... 347/14
See application file for complete search history.

(56) References Cited

U.S. PATENT DOCUMENTS

| | | | | |
|---|---|---|---|---|
| 5,461,406 | A * | 10/1995 | Lorenze, Jr. | B41J 2/1433 347/47 |
| 7,896,458 | B2 * | 3/2011 | Ito | 347/13 |
| 2007/0252869 | A1 * | 11/2007 | Goto et al. | 347/34 |
| 2008/0068411 | A1 * | 3/2008 | Koase | 347/12 |
| 2008/0273203 | A1 * | 11/2008 | Miyahara | 356/425 |
| 2008/0291236 | A1 * | 11/2008 | Kitakami et al. | 347/30 |
| 2009/0128594 | A1 * | 5/2009 | Martinez | B41J 2/5056 347/14 |
| 2010/0007688 | A1 * | 1/2010 | Gao | B41J 2/16579 347/14 |

FOREIGN PATENT DOCUMENTS

| | | | |
|---|---|---|---|
| JP | 2002192714 | A | 7/2002 |
| JP | 2005038277 | A | 2/2005 |
| JP | 2005246690 | A * | 9/2005 |

* cited by examiner

*Primary Examiner* — Shelby Fidler
(74) *Attorney, Agent, or Firm* — Greenblum & Bernstein, P.L.C.

(57) ABSTRACT

An inkjet printer is provided with an influence calculation portion and a device control portion. The influence calculation portion calculates an influence indicating a degree of an influence of generation of a satellite on a printing condition. The device control portion controls discharging timing of an inkjet head so that ink is discharged in order by each row of a plurality of nozzle rows for each pixel row on a sheet as a printing target, if the influence calculated by the influence calculation portion exceeds a predetermined threshold value.

17 Claims, 12 Drawing Sheets

FIG. 4A 151 152

| HEAD GAP | $E_g$ |
|---|---|
| a | 1 |
| b | 1.5 |
| c | 2 |

FIG. 4B 154 155

| TEMPERATURE | $E_t$ |
|---|---|
| d≤t | 1 |
| t<d | 1.2 |

FIG. 4C 157 158

| IMAGE POSITION | $E_l$ |
|---|---|
| OTHER THAN APPLICABLE | 1 |
| APPLICABLE REGION | 1.5 |

FIG. 7

| $E_g$ | $E_t$ | $E_l$ | E |
|---|---|---|---|
| 1 | 1 | 1 | 1 |
| 1 | 1 | 1.5 | 1.5 |
| 1 | 1.2 | 1.5 | 1.8 |
| 2 | 1 | 1 | 2 |
| 1.5 | 1 | 1 | 1.5 |
| 1 | 1.2 | 1 | 1.2 |
| 1 | 1.2 | 1 | 1.2 |

171

172

173

FIG. 13A 181 182

| APPLICABLE IMAGE | $E_p$ |
|---|---|
| NO | 1 |
| YES | 1.5 |

FIG. 13B 157 158

| IMAGE POSITION | $E_l$ |
|---|---|
| OTHER THAN APPLICABLE | 1 |
| APPLICABLE REGION | 1.5 |
| $E_p$=1 | 1 |

FIG. 14

| $E_g$ | $E_t$ | $E_p$ | $E_l$ | E | |
|---|---|---|---|---|---|
| 1 | 1 | 1 | 1 | 1 | 174 |
| 1 | 1 | 1.5 | 1.5 | 2.25 | 175 |
| 1 | 1.2 | 1.5 | 1.5 | 2.7 | 175 |
| 2 | 1 | 1 | 1 | 2 | 175 |
| 1.5 | 1 | 1.5 | 1 | 2.25 | 175 |
| 1 | 1.2 | 1.5 | 1 | 1.8 | 176 |
| 1 | 1.2 | 1 | 1 | 1.2 | 176 |

INKJET PRINTER

CROSS REFERENCE TO RELATED APPLICATION

This application claims benefit of priority under 35 U.S.C. §119 to Japanese Patent Application No. 2013-131395, filed on Jun. 24, 2013, the entire contents of which are incorporated by reference herein.

BACKGROUND OF THE INVENTION

1. Field of the Invention

The present invention relates to an inkjet printer which reduces generation of satellite without lowering productivity and performs printing.

2. Description of the Related Art

Inkjet printers perform printing on a recording medium by discharging ink droplets by an inkjet head and are commonly well known.

An ink droplet discharged from a nozzle of the inkjet head flies in a form of leaving a trail, and a time difference and a speed difference are generated between a head portion and a tail portion of the flying droplet. Thus, unnecessary micro droplets (satellites) might be generated, accompanying preceding major droplets. The satellite adheres onto a recording medium to lower a printing quality or adheres into a device to stain the device.

The generation of satellites is affected by various factors such as a head gap which is a gap between the inkjet head and the recording medium or an ink temperature.

In Patent Literature 1 (Japanese Patent Application Laid-Open Publication No. 2005-38277), a technology relating to a printing system in which resolution of a printer head is selected as a printing setting suitable for a type of a recording medium is proposed.

In Patent Literature 2 (Japanese Patent Application Laid-Open Publication No. 2002-192714), a technology relating to an inkjet type recording device in which resolution is set on the basis of a platen gap is proposed.

In the printing system described in Patent Literature 1, since the resolution of the printer head is selected in accordance with the type of the recording medium, if printing is performed with high resolution, the number of ink droplets discharged from a nozzle increases, which increases a satellite amount. Thus, in order to reduce the satellite amount, if printing is performed with low resolution by discharging ink from a part of the printer head, since an ink temperature of the inkjet head discharging the ink rises, the ink at a raised temperature needs to be cooled. Since a delay is caused by this ink cooling time, productivity might be lowered in some cases.

In the inkjet type recording device described in Patent Literature 2, since the resolution is set on the basis of the platen gap, similarly to the printing system described in Patent Literature 1, the ink needs to be cooled. Since a delay is caused by this ink cooling time, productivity might be lowered in some cases.

SUMMARY OF THE INVENTION

The present invention is made in view of the above problems and has an object to provide an inkjet printer which reduces generation of satellite without lowering productivity and performs printing.

According to a first aspect of the present invention, there is provided an inkjet printer that has an inkjet head in which a plurality of nozzle rows discharging ink are aligned in parallel, and performs printing on a sheet while switching resolution, by discharging ink from the nozzle row selected from the plurality of nozzle rows while the inkjet head and the sheet are relatively moved, including: an influence calculation portion that calculates an influence indicating a degree of an influence of generation of a satellite on the basis of a printing condition; and a control portion that controls discharging timing of the inkjet head so that the ink is discharged in order by each row of the plurality of nozzle rows for each pixel row on the sheet on which printing is to be performed, if the influence calculated by the influence calculation portion exceeds a predetermined threshold value.

According to a second aspect of the present invention, the control portion controls discharging timing of the inkjet head so that the ink is discharged by each row in order from the nozzle row with an elapsed time longer from the closest point of time of discharge in the plurality of nozzle rows for each pixel row on the sheet on which printing is to be performed, if the influence calculated by the influence calculation portion exceeds the predetermined threshold value.

According to a third aspect of the present invention, the control portion controls the discharging timing of the inkjet head so that the ink is discharged by each row in order in a part of the plurality of the nozzle rows for each pixel row on the sheet on which printing is to be performed, if the influence calculated by the influence calculation portion exceeds the predetermined threshold value.

According to a fourth aspect of the present invention, the influence calculation portion calculates an influence indicating a degree of an influence of generation of a satellite, on the basis of presence of an image with a great influence of image deterioration caused by the generation of a satellite or on the basis of an image position.

According to a fifth aspect of the present invention, the inkjet head has an ink chamber communicating with the nozzle and discharges the ink from the nozzle by changing a capacity of the ink chamber on the basis of a supplied driving signal, and the control portion supplies the driving signal with a driving waveform to the inkjet head so as to reduce an ink amount accompanying major ink droplets discharged from the nozzle.

According to a sixth aspect of the present invention, the control portion supplies the driving signal with a driving waveform to the inkjet head so as to reduce the ink amount accompanying the major ink droplets discharged from the nozzle in accordance with a gap between the inkjet head and a transfer portion for transferring the sheet.

According to a seventh aspect of the present invention, the control portion supplies the driving signal of such a degree that the ink is not discharged from the nozzle row other than the nozzle row discharging the ink in the plurality of nozzle rows of the inkjet head.

According to the first aspect of the present invention, the influence calculation portion calculates an influence indicating a degree of an influence of satellite generation on the basis of a printing condition. If the influence calculated by the influence calculation portion exceeds a predetermined threshold value, the discharging timing of the inkjet head is controlled so that the ink is discharged by each row in order of the plurality of nozzle rows for each pixel row on the sheet on which printing is to be performed. Thus, printing with low resolution can be performed. As a result, the number of ink droplets discharged from the nozzle is reduced, which reduces the satellite amount, and also by preventing a rise of an ink temperature of the inkjet head, necessity of cooling of the inkjet head is reduced, which prevents lowering of productivity.

According to the second aspect of the present invention, the control portion controls the discharging timing of the inkjet head so that the ink is discharged by each row in order from the nozzle row with an elapsed time longer from the closest point of time of discharge in the plurality of nozzle rows for each pixel row on the sheet on which printing is to be performed, if the influence calculated by the influence calculation portion exceeds the predetermined threshold value. Thus, the plurality of nozzle rows can be used uniformly, which further reduces the necessity of cooling of the inkjet head to prevent lowering of productivity.

According to the third aspect of the present invention, the discharging timing of the inkjet head is controlled so that the ink is discharged by each row in order in a part of the plurality of the nozzle rows for each pixel row on the sheet on which printing is to be performed, if the influence calculated by the influence calculation portion exceeds the predetermined threshold value. Thus, if ink clogging or the like occurs in one of the nozzle rows, for example, printing can be continued by discharging the ink from the remaining nozzle rows.

According to the fourth aspect of the present invention, the influence calculation portion calculates an influence of satellite generation on the basis of presence of an image with a great influence of image deterioration caused by the generation of a satellite or on the basis of an image position. Thus, the influence can be calculated more appropriately.

According to the fifth aspect of the present invention, a driving signal with a driving waveform so as to reduce an ink amount accompanying the major ink droplets discharged from the nozzle is supplied to the inkjet head. Thus, by changing the driving waveform from a normal waveform to a satellite measure waveform, generation of a satellite can be suppressed.

According to the sixth aspect of the present invention, a driving signal with a driving waveform so as to reduce the ink amount accompanying the major ink droplets discharged from the nozzle is supplied to the inkjet head in accordance with a gap between the inkjet head and a transfer portion for transferring the sheet. Thus, by changing to a satellite measure waveform with preference for a head gap with a great influence of a satellite, generation of a satellite can be suppressed.

According to the seventh aspect of the present invention, a driving signal of such a degree that the ink is not discharged from the nozzle row other than the nozzle row discharging the ink in the plurality of nozzle rows of the inkjet head is supplied. Thus, since excessive drop of a temperature of the inkjet head and temporary stop for heating can be avoided, lowering of productivity can be prevented.

BRIEF DESCRIPTION OF THE DRAWINGS

FIG. 4A is a diagram illustrating an example of a head gap table indicating a relationship between a head gap and a gap influence, stored in a ROM of a control portion provided in the inkjet printer according to the first embodiment of the present invention.

FIG. 4B is a diagram illustrating an example of a temperature table indicating a relationship between an ink temperature and a temperature influence, stored in the ROM of the control portion provided in the inkjet printer according to the first embodiment of the present invention.

FIG. 4C is a diagram illustrating an example of an image position table indicating a relationship between an image position and an image position influence, stored in the ROM of the control portion provided in the inkjet printer according to the first embodiment of the present invention.

FIG. 7 is a diagram illustrating a calculation example of an influence E calculated by a CPU of the inkjet printer according to the first embodiment of the present invention.

FIG. 13A is a diagram illustrating an example of an applicable image table indicating a relationship between presence of an applicable image and an applicable image influence, stored in the ROM of the control portion provided in the inkjet printer according to the second embodiment of the present invention.

FIG. 13B is a diagram illustrating an example of an image position table indicating a relationship between an image position and an image position influence, stored in the ROM of the control portion provided in the inkjet printer according to the second embodiment of the present invention.

FIG. 14 is a diagram illustrating a calculation example of the influence E calculated by the CPU of the inkjet printer according to the second embodiment of the present invention.

DESCRIPTION OF THE EMBODIMENTS

First and second embodiments of the present invention will be described below in detail by referring to the attached drawings.

First Embodiment

Entire Configuration of Inkjet Printer

In this embodiment, a line-type inkjet printer which has inkjet heads aligned in a direction (main-scanning direction) orthogonal to a sheet transfer direction and performs printing on a sheet transferred on a transfer path by discharging an ink from a nozzle of the inkjet head on the basis of image data will be explained as an example.

Figure 1:
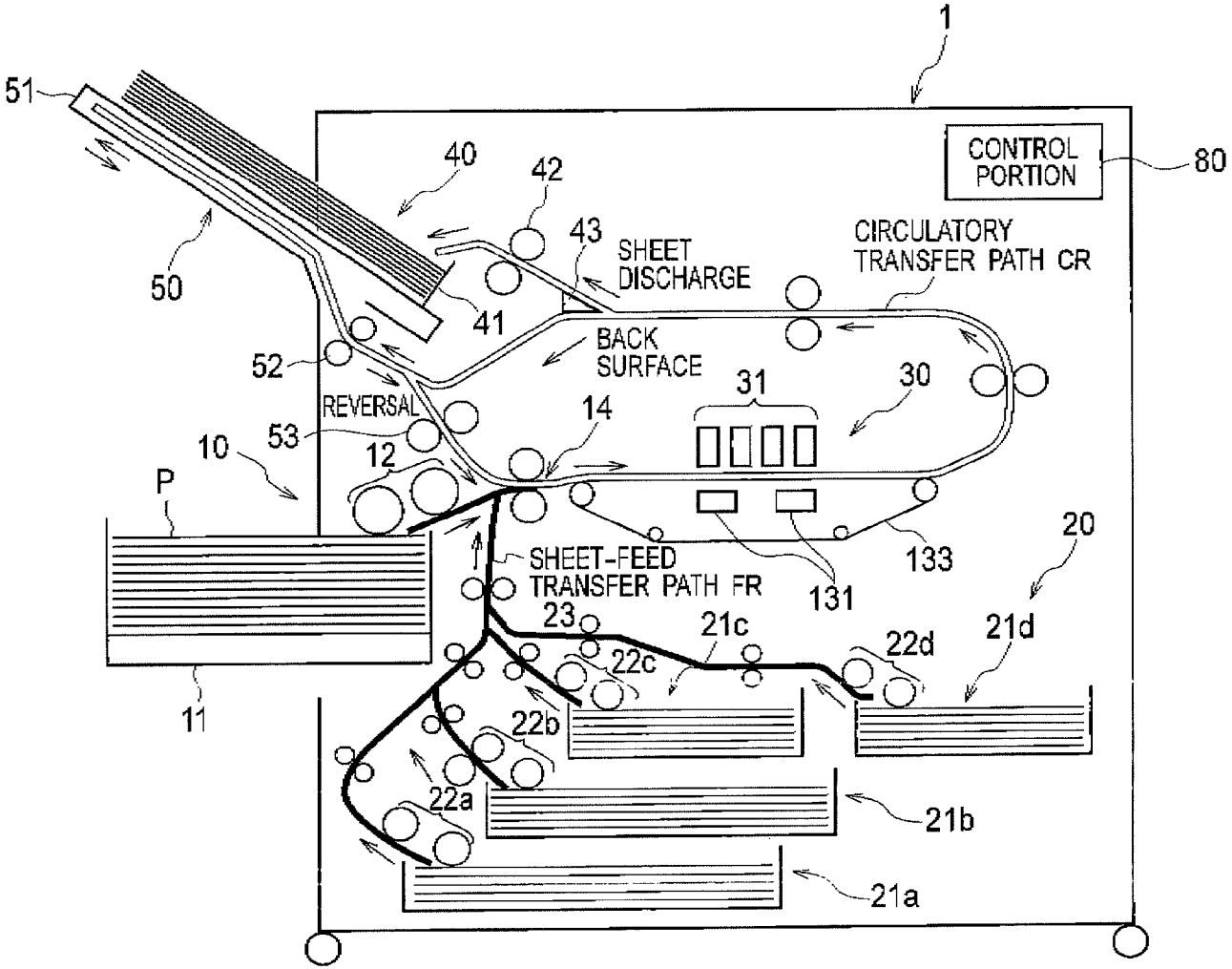
FIG. 1 is a configuration diagram illustrating a configuration of an inkjet printer according to a first embodiment of the present invention.

FIG. 1 is a configuration diagram illustrating a configuration of an inkjet printer 1.

As illustrated in FIG. 1, the inkjet printer 1 is provided with a side sheet-feed portion 10, an internal sheet-feed portion 20, a printing portion 30, a sheet-discharge portion 40, and a reversing portion 50.

The side sheet-feed portion 10 is provided with a sheet receiving tray 11, a primary sheet-feed portion 12, and a secondary sheet-feed portion 14. On the sheet receiving tray 11, sheets P are stacked. The primary sheet-feed portion 12 transfers only the sheet P on the uppermost position from the sheet receiving tray 11 onto a sheet-feed transfer path FR. The secondary sheet-feed portion 14 transfers the sheet P transferred by the primary sheet-feed portion 12 onto a circulatory transfer path CR.

The internal sheet-feed portion 20 is provided with sheet-feed trays 21*a*, 21*b*, 21*c*, and 21*d* and primary sheet-feed portions 22*a*, 22*b*, 22*c*, and 22*d*. On the sheet-feed tray 21*a*, sheets P are stacked. The primary sheet-feed portion 22*a* transfers only the sheet P at the uppermost position from the sheet-feed tray 21*a* onto the sheet-feed transfer path FR. On the sheet-feed tray 21*b*, sheets P are stacked. The primary sheet-feed portion 22*b* transfers only the sheet P at the uppermost position from the sheet-feed tray 21*b* onto the sheet-feed transfer path FR. On the sheet-feed tray 21*c*, sheets P are stacked. The primary sheet-feed portion 22*c* transfers only the sheet P at the uppermost position from the sheet-feed tray 21*c* onto the sheet-feed transfer path FR. On the sheet-feed tray 21*d*, sheets Pare stacked. The primary sheet-feed portion 22*d* transfers only the sheet P at the uppermost position from the sheet-feed tray 21*d* onto the sheet-feed transfer path FR.

As described above, the sheet P may be transferred to the secondary sheet-feed portion 14 from the side sheet-feed portion 10 or the internal sheet-feed portion 20, and moreover, the sheet P may be transferred from the reversing portion 50 which will be described later.

Thus, in front of the secondary sheet-feed portion 14 in a transfer direction, there is a merging point where the transfer path for the fed sheet P merges with a path on which a sheet with one side printed is circulated and transferred. Based on this merging point, a path on a side of a sheet-feed mechanism is referred to as the sheet-feed transfer path FR and the other path is referred to as the circulatory transfer path CR.

The printing portion 30 is provided with an inkjet unit 31 incorporating a plurality of printer heads, and an annular transfer belt 133 provided on a surface faced with the inkjet unit 31. The sheet P fed by the secondary sheet-feed portion 14 is sucked onto the annular transfer belt 133 by a suction fan 131 installed in correspondence with a back surface of a transfer path surface of the sheet. Then, the sucked sheet P is transferred at a predetermined transfer speed, while printing is performed on the sheet P by the ink discharged from the inkjet unit 31.

The sheet P printed by the printing portion 30 is transferred on the circulatory transfer path CR in a housing by a transfer roller or the like arranged on the circulatory transfer path CR. On the circulatory transfer path CR, a switching mechanism 43 for switching between guiding of the sheet P transferred on the circulatory transfer path CR to the sheet-discharge portion 40 and recirculation on the circulatory transfer path CR is provided.

The switching mechanism 43 switches the sheet P to guide it to either one of the sheet-discharge portion 40 which will be described later or the reversing portion 50.

The sheet-discharge portion 40 has a sheet receiving tray 41 having a tray shape protruding from the housing of the inkjet printer 1, and a pair of sheet-discharge rollers 42 for guiding the sheet P to the sheet receiving tray 41. Then, the sheet P guided by the switching mechanism 43 to the sheet-discharge portion 40 is transferred by the sheet-discharge roller 42 to the sheet receiving tray 41 and stacked on the sheet receiving tray 41 with a printed surface downward.

The reversing portion 50 is provided with a reversing base 51 for reversing the sheet P, and a reversing roller 52 which transfers the sheet P from the circulatory transfer path CR to the reversing base 51 or transfers the sheet P from the reversing base 51 onto the circulatory transfer path CR.

The sheet P guided by the switching mechanism 43 to the reversing portion 50 is transferred by the reversing roller 52 from the circulatory transfer path CR to the reversing base 51, and after a predetermined time has elapsed, it is transferred from the reversing base 51 to the circulatory transfer path CR, whereby the front and back of the sheet P is reversed with respect to the circulatory transfer path CR. Then, the sheet P having been turned upside down is transferred by a plurality of rollers such as the transfer roller 53 provided on the circulatory transfer path CR, toward the printing portion 30 on the circulatory transfer path CR.

Moreover, the inkjet printer 1 has a control portion 80 for controlling the entire inkjet printer 1. The control portion 80 executes printing processing on the basis of image data by controlling the side sheet-feed portion 10, the internal sheet-feed portion 20, the printing portion 30, the sheet-discharge portion 40, and the reversing portion 50.

Figure 2:
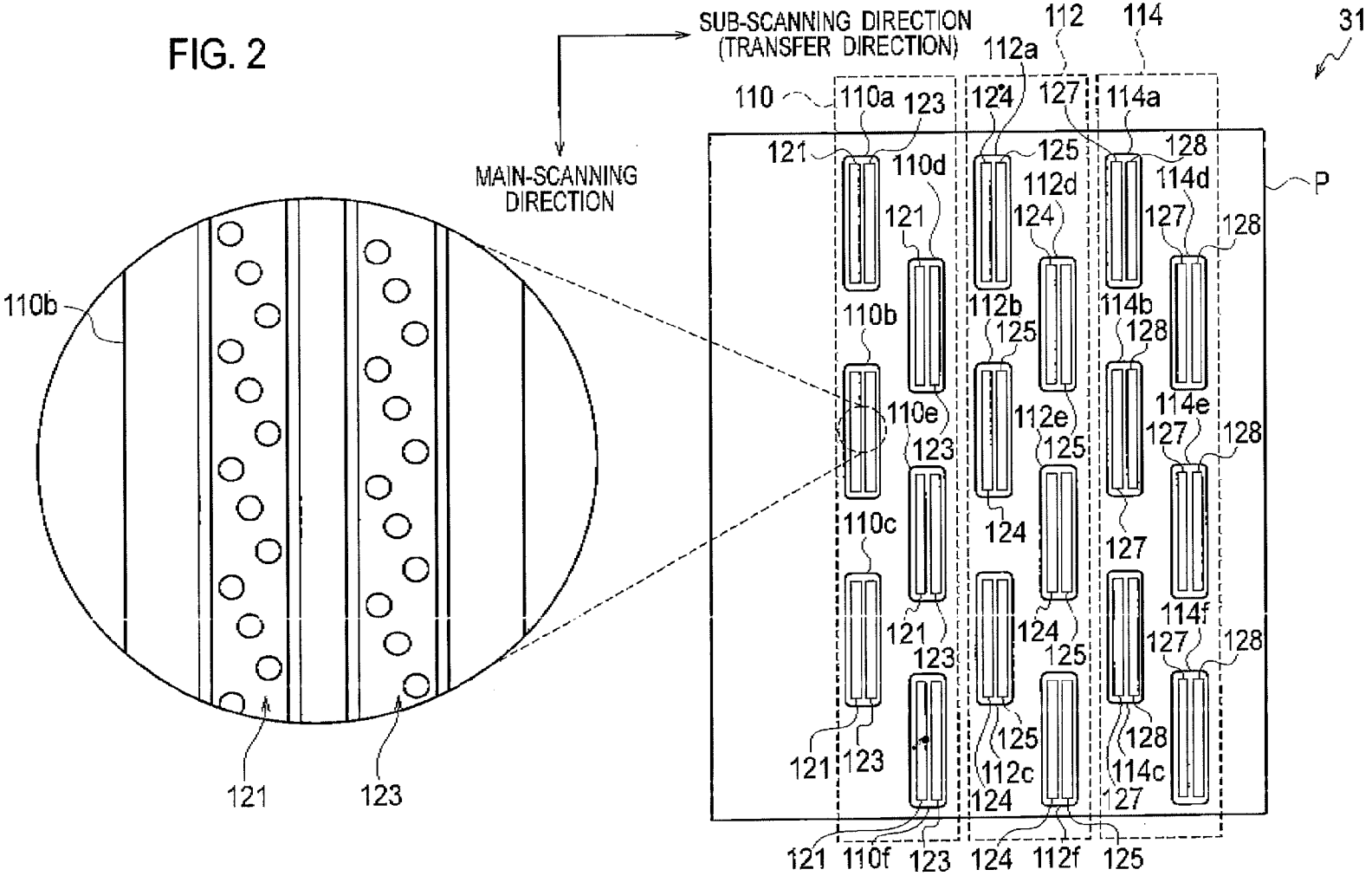
FIG. 2 is a plan view of an inkjet unit provided in the inkjet printer according to the first embodiment of the present invention.

FIG. 2 is a plan view of the inkjet unit 31 provided in the inkjet printer 1.

The inkjet unit 31 has a plurality of line-type inkjet heads 110, 112, and 114 in each of which two rows of nozzles are aligned in a main-scanning direction, that is, in a direction orthogonal to the transfer direction of the sheet P.

While the sheet P is transferred in a sub-scanning direction (transfer direction of the sheet P) on a lower part of the inkjet unit 31, printing is performed by discharge of the ink from the plurality of inkjet heads 110, 112, and 114.

The inkjet unit 31 has inkjet heads 110*a* to 110*f* storing ink in black (K), inkjet heads 112*a* to 112*f* storing ink in cyan (C) and magenta (M), and inkjet heads 114*a* to 114*f* storing ink in yellow (Y). The inkjet heads 110*a* to 110*f*, the inkjet heads 112*a* to 112*f*, and the inkjet heads 114*a* to 114*f* have the same physical structure though colors of discharged ink are different.

In each of the inkjet heads 110*a* to 110*f*, a nozzle row 121 on an upstream side in which nozzles are aligned at a pitch interval for realizing resolution of 300 dpi, and a nozzle row 123 on a downstream side in which nozzles are aligned at a pitch interval for realizing resolution of 300 dpi are arranged so as to be in parallel with the main-scanning direction. The nozzle rows 121 and 123 are provided with the positions of the nozzles in the main-scanning direction shifted from each other. By means of discharge of the ink in the same color (black, here) from the nozzle rows 121 and 123, resolution of 600 dpi is realized.

In each of the inkjet heads 110*a* to 110*f*, an ink chamber for containing the ink in black (K) is provided. In the ink chamber, a piezo element is arranged. On the basis of a supplied driving signal, a driving voltage for discharging the ink is applied to the piezo element, whereby the ink in black (K) is discharged by the unit of drop from the nozzle communicating with the ink chamber. Though not shown, a thermometer for measuring an ink temperature is provided in each of the inkjet heads 110*a* to 110*f*.

As described above, by discharging the ink in black (K) from the nozzle rows 121 and 123 arranged in the main-scanning direction, print can be performed with the resolution of 600 (dpi).

In each of the inkjet heads 112*a* to 112*f*, a nozzle row 124 on an upstream side in which nozzles discharging the ink in cyan (C) are aligned at a pitch interval for realizing resolution of 300 dpi and a nozzle row 125 on a downstream side in which nozzles discharging the ink in magenta (M) are aligned at a pitch interval for realizing resolution of 300 dpi are arranged so as to be in parallel with the main-scanning direction.

In each of the inkjet heads 112*a* to 112*f*, an ink chamber for containing the ink in cyan (C) and an ink chamber for containing the ink in magenta (M) are provided. In the ink chamber, the piezo element is arranged. On the basis of a driving signal, a driving voltage for discharging the ink is applied to the piezo element, whereby the ink in cyan (C) or magenta (M) is discharged by the unit of drop from the nozzle communicating with the ink chamber in cyan (C) or magenta (M). Though not shown, a thermometer for measuring an ink temperature is provided in each of the inkjet heads 112*a* to 112*f*.

As described above, in the nozzle rows 124 and 125 arranged in the main-scanning direction, the nozzle row 124 on the upstream side discharges the ink in cyan (C), and the nozzle row 125 on the downstream side discharges the ink in magenta (M), whereby cyan (C) and magenta (M) are printed with resolution of 300 (dpi), respectively.

In each of the inkjet heads 114*a* to 114*f*, a nozzle row 127 on an upstream side in which nozzles discharging the ink in yellow (Y) are aligned at a pitch interval for realizing resolution of 300 dpi and a nozzle row 128 of spare ink on a downstream side in which nozzles discharging the ink in a spare color are aligned at a pitch interval for realizing resolution of 300 dpi are arranged so as to be in parallel with the main-scanning direction.

In each of the inkjet heads 114*a* to 114*f*, an ink chamber for containing the ink in yellow (Y) and an ink chamber containing the spare ink are provided. In the ink chamber, a piezo element is arranged. On the basis of a driving signal, a driving voltage for discharging the ink is applied to the piezo element, whereby the ink in yellow (Y) or in the spare ink color is discharged by the unit of drop from the nozzle communicating with the ink chamber in yellow (Y) or in the spare ink color. Though not shown, a thermometer for measuring an ink temperature is provided in each of the inkjet heads 114*a* to 114*f*.

As described above, by discharging the ink in yellow (Y) from the nozzle row 127 on the upstream side and by discharging the spare ink from the nozzle row 128 on the downstream side in the nozzle rows 127 and 128 arranged in the main-scanning direction, colors of yellow (Y) and the spare ink are printed with the resolution of 300 (dpi), respectively.

The spare ink may be cyan (C), magenta (M), yellow (Y) or black (K) and may be light cyan (LC) or light magenta (LM).

(Functional Configuration of Inkjet Printer 1)

Subsequently, a functional configuration of the inkjet printer 1 will be described.

Figure 3:
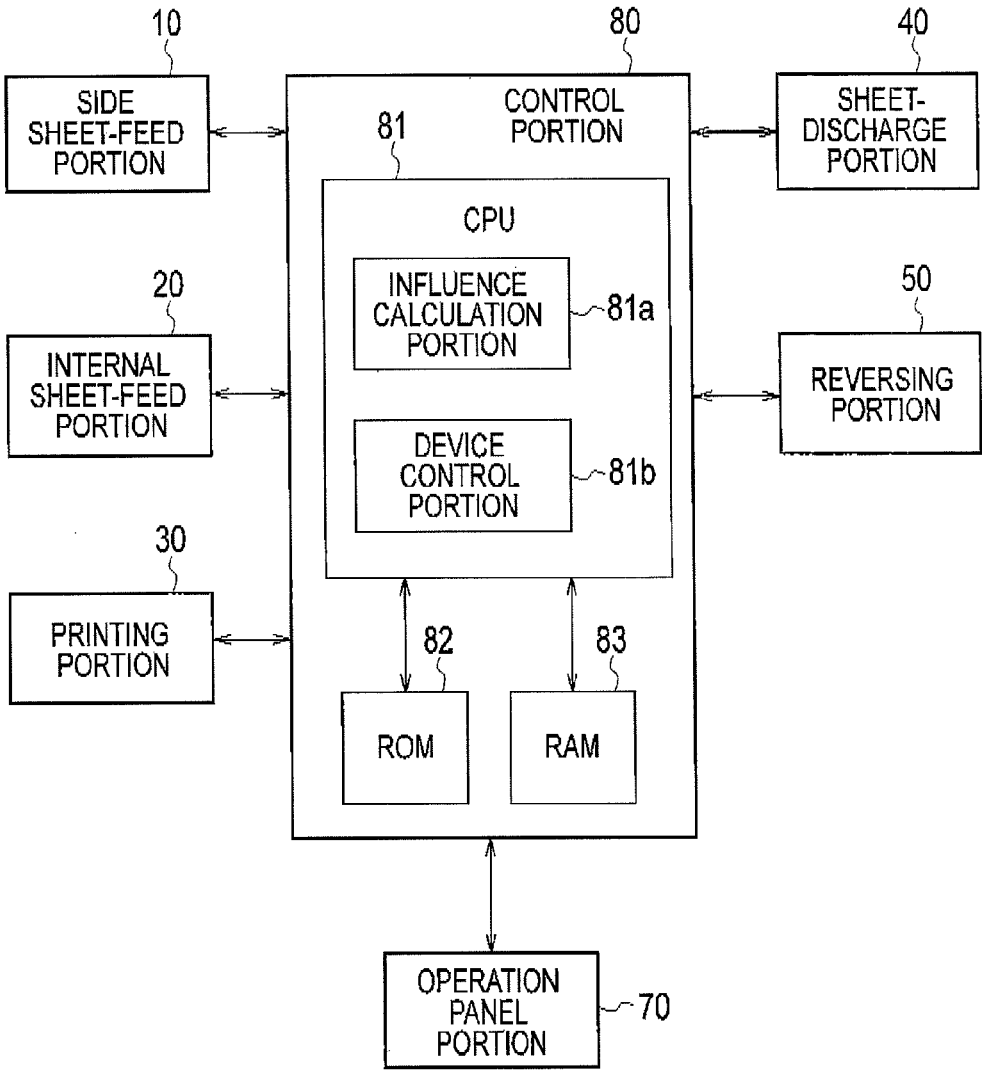
FIG. 3 is a diagram illustrating a functional configuration of the inkjet printer according to the first embodiment of the present invention.

FIG. 3 is a diagram illustrating a functional configuration of the inkjet printer 1.

As illustrated in FIG. 3, the inkjet printer 1 is provided with the side sheet-feed portion 10, the internal sheet-feed portion 20, the printing portion 30, the sheet-discharge portion 40, the reversing portion 50, an operation panel portion 70, and the control portion 80. Among these configurations, since the side sheet-feed portion 10, the internal sheet-feed portion 20, the printing portion 30, the sheet-discharge portion 40, and the reversing portion 50 have been described above, the explanation will be omitted.

The control portion 80 has a CPU 81, a ROM 82 storing operation programs of the CPU 81 and various tables and the like, and a RAM 83 storing image data read by an image reading portion (not shown) or image data transmitted by a computer device (not shown) and a printing job including various printing conditions from an operation panel portion 70 or the computer device (not shown).

FIG. 4A is a diagram illustrating an example of a head gap table indicating a relationship between a head gap and a gap influence Eg stored in the ROM 82 of the control portion 80 provided in the inkjet printer 1. FIG. 4B is a diagram illustrating an example of a temperature table indicating a relationship between an ink temperature and a temperature influence Et stored in the ROM 82 of the control portion 80 provided in the inkjet printer 1. FIG. 4C is a diagram illustrating an example of an image position table indicating a relationship between an image position and an image position influence E1 stored in the ROM 82 of the control portion 80 provided in the inkjet printer 1.

As illustrated in FIG. 4A, a column name "head gap" (reference numeral 151) and a column name "gap influence Eg" (reference numeral 152) are associated with each other and stored as a head gap table. Here, the head gap 151 is set in accordance with a thickness of a sheet such as a normal sheet, an envelope sheet and the like, for example, in stages such as "a", "b", and "c".

Since the larger the head gap 151 is, over the wider range a mist is diffused, it has a great influence on a satellite. Thus, if a relationship of $a<b<c$ holds true, in the head gap table, the head gap 151 and the gap influence Eg are associated with each other so that, the larger the head gap 151 is, the larger a value of the gap influence Eg (reference numeral: 152) indicating a degree of the influence of satellite generation becomes.

As illustrated in FIG. 4B, a column name "temperature" (reference numeral 154) and a column name "temperature influence Et" (reference numeral 155) are associated with each other and stored as a temperature table.

The ink used in the inkjet printer 1 has a temperature characteristic that viscosity changes depending on a temperature condition such that viscosity is high at a low temperature and viscosity is low at a high temperature. If viscosity is high, the ink flies, leaving a long trail, and droplets which become a satellite increase and thus, the influence on the satellite is great. Thus, in the temperature table, the temperature 154 and the temperature influence Et are associated with each other so that, when the temperature 154 is low, a value of the temperature influence Et becomes large.

More specifically, in the temperature table, the temperature 154 and the temperature influence Et are associated with each other so that, if a temperature t is not less than a temperature threshold value d, a value of the temperature influence Et becomes "1", while if the temperature t is less than the temperature threshold value d, the value of the temperature influence Et becomes "1.2".

As illustrated in FIG. 4C, a column name "image position" (reference numeral 157) and a column name "image position E1" (reference numeral 158) are associated with each other and stored as an image position table.

In the inkjet printer 1, the suction fan 131 is provided in the transfer belt 133. Since the sheet P is adsorbed onto the transfer belt 133 and transferred by means of suctioning of the suction fan 131, an air flow going around the sheet is generated by the suctioning by the suction fan 131. A mist (satellite) generated by the ink discharge rides on this air flow and hits a spot shifted from the discharge position, whereby the printed image is deteriorated. At this time, since an air flow going around the sheet P is generated toward a direction of an end portion which is the closest on the sheet P, a flow velocity of the air flow becomes faster when it is close to the end portion of the sheet P. Thus, the closer the image to be printed is to the end portion of the sheet P, the grater the influence of the satellite is. That is, the flow velocity of the air flow is faster and the influence of the satellite is greater on a peripheral region than on a center region of the sheet P.

Thus, the image position influence E1 (reference numeral: 158) is determined whether the image is located in the center region or in the peripheral region.

Figure 5:
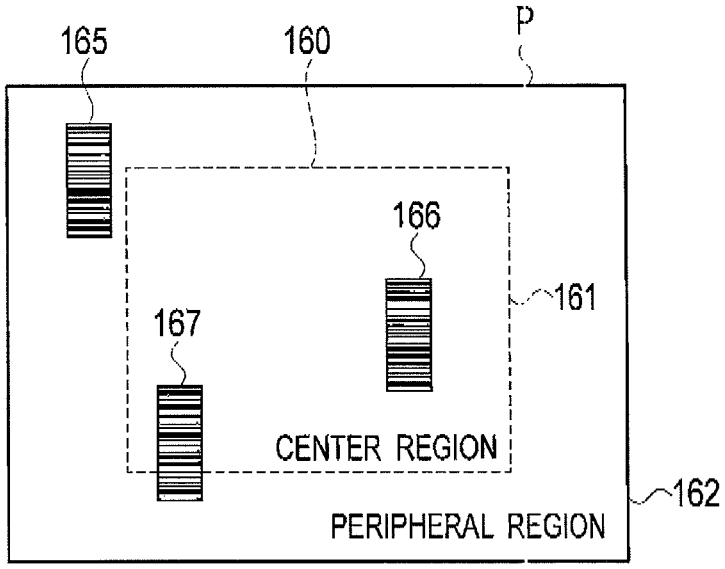
FIG. 5 is a diagram for explaining the image position in the inkjet printer according to the first embodiment of the present invention.

FIG. 5 is a diagram for explaining the image position in the inkjet printer 1. Here, an example in which a barcode image which is a special image is included in the image data will be described.

As illustrated in FIG. 5, the control portion 80 provides a boundary 160 which divides a region into the center region 161 and the peripheral region 162 on the sheet P in advance. If a part of the barcode image is included in the peripheral region 162, the control portion 80 determines that the barcode image is located in an applicable region, while if the entire barcode image is included in the center region 161, the control portion 80 determines that the barcode image is not in the applicable region.

For example, the entire barcode image 165 illustrated in FIG. 5 is located within the peripheral region 162 and thus, the barcode image is determined to be in the applicable region. Moreover, a part of the barcode image 167 is located in the peripheral region 162, and thus, the barcode image is determined to be within the applicable region.

On the other hand, since the entire barcode image 166 is in the center region 161, the barcode image is determined to be not in the applicable region.

Thus, in the image position table illustrated in FIG. 4C, the image position 157 and the image position influence E1 are associated with each other so that, if the image position 157 is not in the applicable region, that is, if it is in the center region, the image position influence E1 is made smaller, while if it is in the peripheral region, the image position influence E1 is made larger.

Returning to FIG. 3, the CPU 81 controls the operations of the entirety of this device, that is, the side sheet-feed portion 10, the internal sheet-feed portion 20, the printing portion 30, the sheet-discharge portion 40, the reversing portion 50, the operation panel portion 70 and the like by executing the operation program stored in the ROM 82. Moreover, the CPU 81 implements an influence calculation portion 81*a* and a device control portion 81*b*.

The influence calculation portion 81*a* calculates an influence indicating a degree of an influence of satellite generation on the basis of the printing condition.

The device control portion 81*b* controls discharging timing of the inkjet heads 110*a* to 110*f* so that, if the influence calculated by the influence calculation portion 81*a* exceeds a predetermined threshold value, the ink is discharged by each row in order from the nozzle row with an elapsed time longer from the closest point of time of discharge in the plurality of nozzle rows for each pixel row in parallel with the plurality of nozzle rows (two nozzle rows, here) on the sheet P on which printing is to be performed.

Moreover, the device control portion 81*b* supplies a driving signal with a satellite measure waveform so as to reduce the ink amount accompanying the major ink droplets discharged from the nozzle in accordance with an interval between the inkjet heads 110*a* to 110*f* and transfer unit for transferring the sheet P to the inkjet heads 110*a* to 110*f*.

Moreover, the device control portion 81*b* supplies a driving signal of such a degree that the ink is not discharged, to the nozzle row other than the nozzle row discharging the ink in the plurality of nozzle rows 121 and 123 of the inkjet heads 110*a* to 110*f*. For example, while the ink in black (K) is being discharged from the nozzle row 121 on the upstream side, the driving signal of such a degree that the ink is not discharged from the nozzle row 123 on the downstream side is supplied to the inkjet heads 110*a* to 110*f*. As a result, excessive drop of the temperature of the inkjet heads 110*a* to 110*f* can be prevented.

The operation panel portion 70 is provided with a display/input panel (not shown) and various operation keys such as a start key for starting printing, a stop key for stopping the printing, and a ten key pad for input of the number of sheets to be printed (none of them is shown). The operation panel portion 70 supplies an operation signal on the basis of a user's operation to the control portion 80.

Subsequently, a detailed processing procedure of the inkjet printer 1 will be described.

Figure 6:
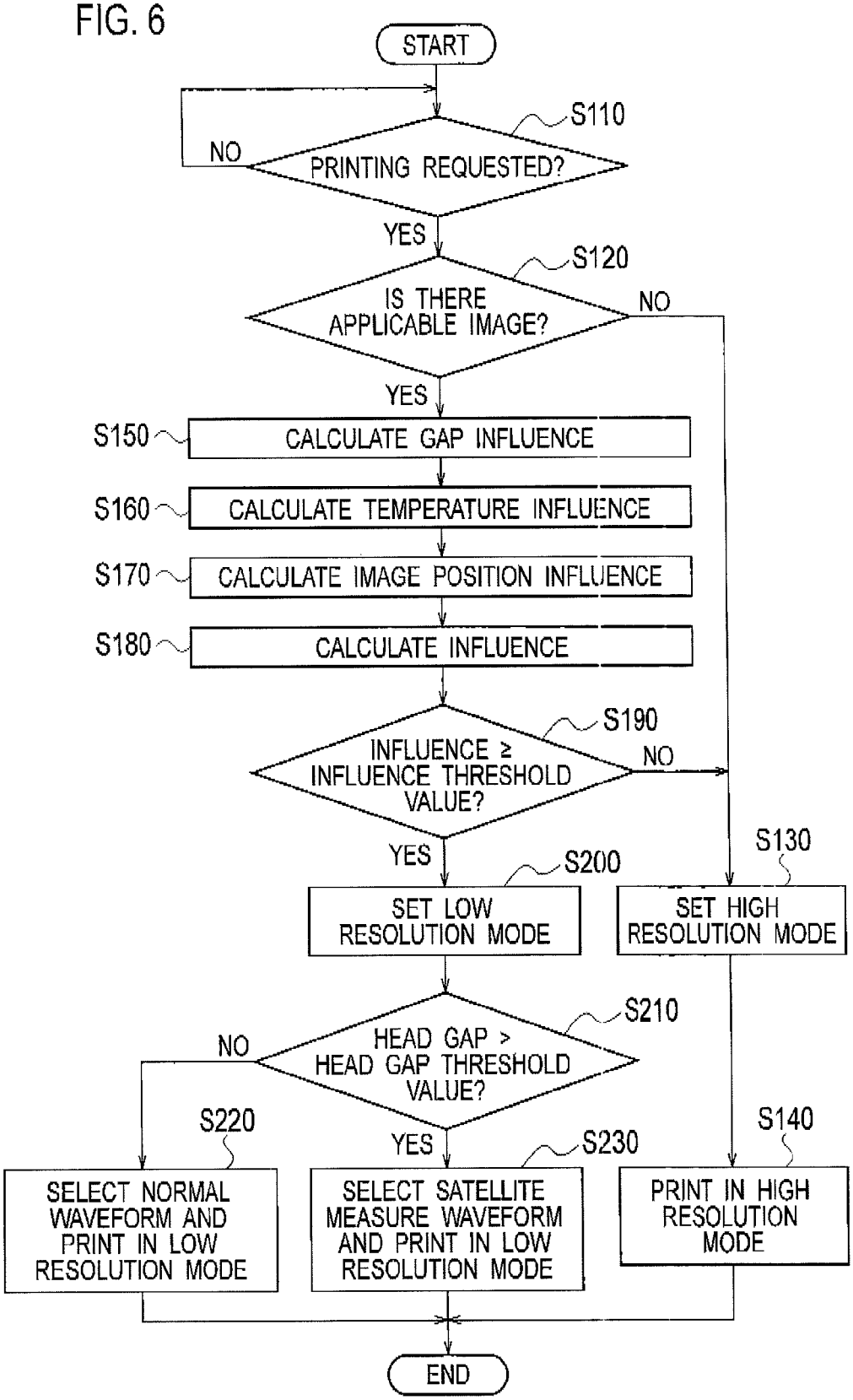
FIG. 6 is a flowchart illustrating a processing procedure of the inkjet printer according to the first embodiment of the present invention.

FIG. 6 is a flowchart illustrating the processing procedure of the inkjet printer 1.

As illustrated in FIG. 6, first, the CPU 81 of the control portion 80 determines whether or not printing has been requested (S110). More specifically, if a printing start operation is made by the operation panel portion 70, or if a printing job including various printing conditions is received from a computer device, not shown, the CPU 81 determines that printing has been requested.

At Step S110, if it is determined that the printing has been requested (YES), the influence calculation portion 81*a* of the CPU 81 determines whether or not there is an applicable image (S120). Image data as a printing target might include a special image indicating a code such as a lateral barcode or a two-dimensional barcode. If such a special image is included, generation of a satellite lowers a recognition rate. Moreover, if a framed character is included, generation of a satellite might make the character illegible. Thus, it is determined whether or not an applicable image, that is, a special image or a framed image with a great influence on image deterioration by generation of a satellite is included in the image data as a printing target.

At Step S120, if it is determined that there is no applicable image (NO), the CPU 81 sets a high resolution mode (S130) and executes printing in the high resolution mode (S140). More specifically, the device control portion 81*b* of the CPU 81 sets the high resolution mode (600 dpi, here), and the inkjet heads 110*a* to 110*f* discharge the ink in black (K) from the nozzle rows 121 and 123 on the upstream and downstream sides in the main-scanning direction, whereby printing is performed with the resolution of 600 (dpi). The inkjet heads 112*a* to 112*f* perform printing with the resolution of 300 (dpi) by discharging the ink of cyan (C) and magenta (M), respectively. The inkjet heads 114*a* to 114*f* perform printing with the resolution of 300 (dpi) by discharging the ink of yellow (Y).

On the other hand, at Step S120, if it is determined that there is an applicable image (YES), the influence calculation portion 81*a* of the CPU 81 calculates the gap influence Eg (S150). In accordance with the thickness of the sheet determined by a type of the sheet, any one of the head gaps "a", "b", and "c" is set. Thus, the influence calculation portion 81*a* calculates the gap influence Eg on the basis of the set head gap and the head gap table stored in the ROM 82.

Subsequently, the influence calculation portion 81*a* calculates the temperature influence Et (S160). More specifically, the influence calculation portion 81*a* obtains a temperature of the ink from the thermometer provided in each of the inkjet heads 110*a* to 110*f* and calculates the temperature influence Et on the basis of the obtained temperature and the temperature table stored in the ROM 82.

Then, the influence calculation portion 81*a* calculates the image position influence E1 (S170). More specifically, the influence calculation portion 81*a* obtains a coordinate of the applicable image included in the printing job and determines whether the applicable image is located in the center region 161 or in the peripheral region 162. The influence calculation portion 81*a* calculates the image position influence E1 on the basis of this determination result and the image position table stored in the ROM 82.

Subsequently, the influence calculation portion 81*a* calculates an influence (S180). More specifically, the influence calculation portion 81*a* calculates the influence E by using the following (formula 1) on the basis of the obtained gap influence Eg, temperature influence Et, and image position influence E1.

$$\text{Influence } E = Eg \times Et \times E1 \qquad \text{(formula 1).}$$

Subsequently, the influence calculation portion 81*a* determines whether or not the influence E calculated at Step S180 is not less than an influence threshold value Eth (S190).

FIG. 7 is a diagram illustrating a calculation example of the influence E calculated by the CPU 81 of the inkjet printer 1.

As illustrated in FIG. 7, by substituting the obtained gap influence Eg, temperature influence Et, and image position influence E1 in the above described (formula 1), the influence E is calculated.

As the influence threshold value Eth, an appropriate value needs to be set in advance by a user and the like. In this embodiment, the influence threshold value Eth is set to "1.5".

That is, since the influence E indicated at 171 and 173 illustrated in FIG. 7 is smaller than "1.5" which is the value of the influence threshold value Eth, the CPU 81 determines that the influence E is less than the influence threshold value Eth. Since the influence E indicated at 172 illustrated in FIG. 7 is larger than "1.5" which is the value of the influence threshold value Eth, the device control portion 81*b* of the CPU 81 determines that the influence E is not less than the influence threshold value Eth.

If it is determined at Step S190 that the influence E is not less than the influence threshold value Eth (YES), the device control portion 81*b* of the CPU 81 sets a low resolution mode (S200). Here, the low resolution mode is a mode in which printing is performed at 300 dpi by discharging the ink in black (K) alternately from the nozzle row 121 on the upstream side and the nozzle row 123 on the downstream side so that the ink is discharged from each of the nozzle rows alternately from the nozzle rows 121 or 123 arranged in the inkjet heads 110*a* to 110*f* for each pixel row in the sheet P on which the printing is to be performed.

Subsequently, the device control portion 81*b* of the CPU 81 determines whether or not the head gap has exceeded a head gap threshold value (S210). For example, assuming that the head gap threshold value is Hth, it is so set in advance that a relationship of $a<b<Hth<c$ holds true among the head gaps a, b, and c, and the head gap threshold value Hth. If the head gap is "c", the device control portion 81*b* of the CPU 81 determines that the head gap has exceeded the head gap threshold value Hth. If the head gap is "a" or "b", the CPU 81 determines that the head gap has not exceeded the head gap threshold value Hth.

At Step S210, if it is determined that the head gap has not exceeded the head gap threshold value Hth (NO), the device control portion 81*b* of the CPU 81 selects a normal waveform as the driving waveform to the inkjet heads 110*a* to 110*f* and performs printing in the low resolution mode (S220).

Figure 8:
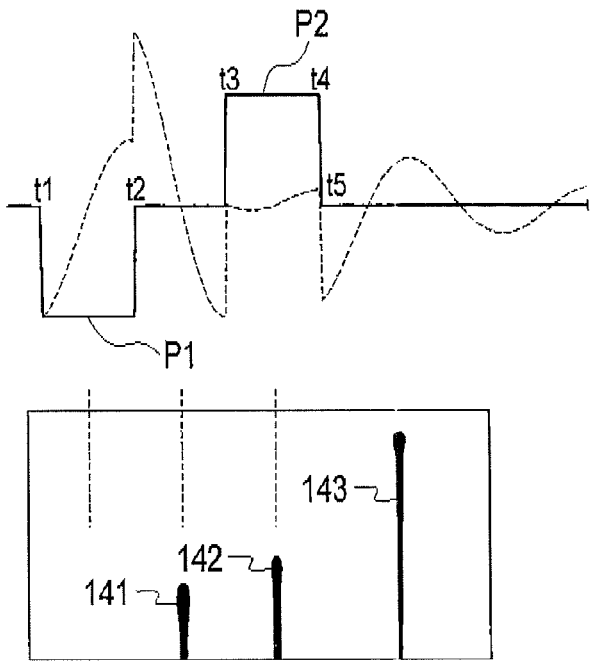
FIG. 8 is an explanatory diagram indicating a relationship between a driving signal with a normal waveform of the inkjet printer according to the first embodiment of the present invention and a pressure change of the ink in a ink chamber of an inkjet head driven by the driving signal with the normal waveform, and an explanatory diagram illustrating a change in a droplet shape of the ink discharged when the inkjet head is driven by the driving signal with the normal waveform.

An upper figure in FIG. 8 is an explanatory diagram illustrating a relationship between a driving signal with the normal waveform of the inkjet printer 1 and a pressure change of the ink in the ink chamber of the inkjet head driven by it. In the upper figure in FIG. 8, a solid line indicates a waveform of the driving signal, and a broken line indicates a pressure of the ink in the ink chamber. Moreover, a lower figure in FIG. 8 is an explanatory diagram illustrating a change of a droplet shape of the ink discharged when the inkjet head is driven by the driving signal in the upper figure in FIG. 8.

When the driving signal indicated by a solid line in the upper figure in FIG. 8 is supplied to the inkjet head, at time t1 in the upper figure in FIG. 8, a driving pulse P1 with a negative voltage (−VA) is applied to an electrode of the ink chamber. Then, a capacity of the ink chamber is expanded. As a result, a pressure of the ink in the ink chamber decreases, and the ink flows into the ink chamber from an ink tank, not shown.

An application period of time of the driving pulse P1 is 1 AL from the time t1 to time t2. AL (Acoustic Length) is a period of time until a pressure wave generated by inflow of the ink into the ink chamber whose capacity is expanded propagates over the whole region of the ink chamber and reaches the nozzle, that is, ½ of an acoustic resonant period of the ink chamber. This AL is determined depending on a structure of the inkjet head, ink density and the like.

Subsequently, at the time t2 in the upper figure in FIG. 8, a voltage applied to the electrode of the ink chamber is returned to grounding potential. Then, the ink in the ink chamber is pressurized, and the ink is discharged from the corresponding nozzle.

When 1.0 AL has elapsed since the voltage applied to the electrode of the ink chamber is returned to the grounding potential, for a period of 1.0 AL from time t3 to time t4, a driving pulse P2 with a positive voltage (VA) is applied to the electrode of the ink chamber. As a result, the capacity of the ink chamber is reduced.

After the application of the driving pulse P2, for a period from the time t4 to time t5, a voltage applied to the electrode of the ink chamber is made the grounding potential.

As described above, the normal waveform is a waveform of a voltage applied to the electrode so that, after the capacity of the ink chamber is expanded, it is returned to the original capacity and subsequently, the capacity is reduced and then, it is returned to the original capacity again.

The CPU 81 performs printing at 300 dpi by discharging the ink in black (K) alternately from the nozzle row 121 on the upstream side or the nozzle row 123 on the downstream side by using the driving waveform of a normal waveform so that the ink is discharged alternately from each row in the nozzle rows 121 and 123 arranged in the inkjet heads 110*a* to 110*f*.

Returning to FIG. 6, at Step S210, if it is determined that the head gap has exceeded the head gap threshold value Hth (YES), the device control portion 81*b* of the CPU 81 selects the satellite measure waveform as the driving waveform to the inkjet heads 110*a* to 110*f* and performs printing in the low resolution mode (S230).

Figure 9:
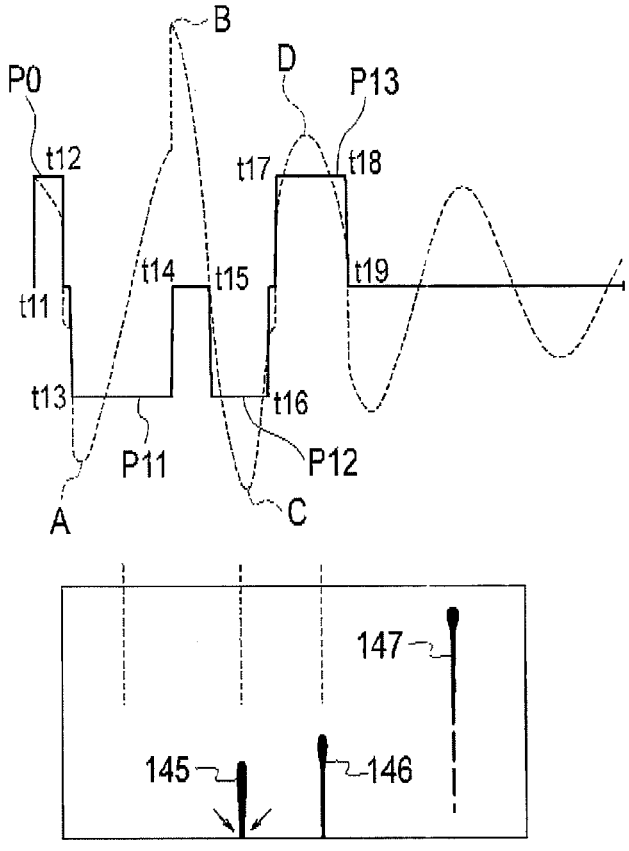
FIG. 9 is an explanatory diagram indicating a relationship between a driving signal with a satellite measure waveform of the inkjet printer according to the first embodiment of the present invention and a pressure change of the ink in the ink chamber of the inkjet head driven by the driving signal with the satellite measure waveform, and an explanatory diagram illustrating a change in the droplet shape of the ink discharged when the inkjet head is driven by the driving signal with the satellite measure waveform.

An upper figure in FIG. 9 is an explanatory diagram illustrating a relationship between the driving signal with the satellite measure waveform of the inkjet printer 1 and a pressure change of the ink in the ink chamber of the inkjet head driven by that. In the upper figure in FIG. 9, a solid line indicates a waveform of the driving signal and a broken line indicates a pressure of the ink in the ink chamber. Moreover, a lower figure in FIG. 9 is an explanatory diagram illustrating a change of a droplet shape of the ink discharged when the inkjet head is driven by the driving signal in the upper figure in FIG. 9.

In a case where this satellite measure waveform is used, when the driving signal indicated by the solid line in the upper figure in FIG. 9 is supplied to the inkjet head, at time t11 in the upper figure in FIG. 9, a driving pulse P0 with the positive voltage (VA) is applied to the electrode of the ink chamber. As a result, the capacity of the ink chamber is reduced.

At time t12 in the upper figure in FIG. 9, the voltage applied to the electrode of the ink chamber is returned to the grounding potential, and at time t13 immediately after the time t12, a driving pulse P11 with a negative voltage (−VA) is applied to the electrode of the ink chamber. Consequently, the capacity of the ink chamber is expanded, and as a result, the pressure of the ink in the ink chamber is reduced, and the ink flows into the ink chamber from the ink tank, not shown.

An application period of time of the driving pulse P11 in the driving signal with the satellite measure waveform is 1.0 AL from the time t13 to time t14 similarly to the driving pulse P1 in the driving signal with the normal waveform.

Subsequently, at the time t14 in the upper figure in FIG. 9, the voltage applied to the electrode of the ink chamber is returned to the grounding potential. Then, the ink in the ink chamber is pressurized, and the ink is discharged from the corresponding nozzle.

When 0.4 AL has elapsed since the voltage applied to the electrode of the ink chamber is returned to the grounding potential, for a period of 0.6 AL from time t15 to time t16 in the upper figure in FIG. 9, a driving pulse P12 with a negative voltage (−VA) is applied to the electrode of the ink chamber. As a result, the capacity of the ink chamber is expanded.

Subsequently, at time t16 in the upper figure in FIG. 9, the voltage applied to the electrode of the ink chamber is returned to the grounding potential, and for a period of time to time t18 after 0.75 AL has elapsed since time t17 after an extremely short time from the time t16, a driving pulse P13 with a positive voltage VB is applied to the electrode of the ink chamber. As a result, the capacity of the ink chamber is reduced.

Before the driving pulse P13 with the positive voltage VB is applied to the electrode of the ink chamber, a degree of reduction of the ink pressure in the ink chamber is amplified by application of the driving pulse P12 to the electrode of the ink chamber. Thus, by generating a pressurizing force by applying the driving pulse P13 so as to reduce the capacity in the ink chamber, generation of a satellite is suppressed after the ink discharge. Thus, a pressure fluctuation period in the ink chamber in which a degree of reduction in the ink pressure is amplified is made short, and time required for the pressure in the ink chamber to return to a normal pressure can be reduced. Moreover, by reducing the time for the pressure in the ink chamber to return to the normal pressure, the driving pulse P13 can play a role like the driving pulse P0 in preparation for multi-drop of discharging a plurality of drops for one pixel.

After application of the driving pulse P13, during a period from time t18 to time 19, the voltage applied to the electrode of the ink chamber is made the grounding potential.

As described above, the satellite measure waveform is a waveform of a voltage applied to the electrode so that, after the capacity of the ink chamber is expanded, it is returned to the original capacity and subsequently, the capacity is expanded again and then, returned to the original capacity again and then, the capacity is reduced and returned to the original capacity again.

In the above described driving signal of the normal waveform, as indicated by the broken line in the upper figure in FIG. 8, at the time t2 when the pressure of the ink in the ink chamber which is made negative by start of application of the driving pulse P1 to the electrode of the ink chamber exceeds a peak of the negative pressure and changes to increase and exceeds a normal pressure and reaches a peak of a positive pressure, the application of the driving pulse P1 is finished. As a result, discharge of the ink is started. Then, at the time t3 when the ink is discharged, and the pressure of the ink in the ink chamber changes to decrease and exceeds the normal pressure by pressure reduction occurring in the ink chamber and reaches the peak of the negative pressure, application of the driving pulse P2 is started. As a result, a pressurizing force is generated in the ink in the ink chamber after the ink discharge, whereby reduction of the ink pressure is suppressed, and remaining vibration of the ink is suppressed. By suppressing the remaining vibration as above, the subsequent discharge operation can be performed stably as described above.

On the other hand, with the driving signal of the satellite measure waveform such that the ink amount accompanying the major ink droplets discharged from the nozzle is reduced, the pressure of the ink in the ink chamber which became positive by start of application of the driving pulse P0 to the electrode of the ink chamber is insufficient to discharge the ink from the nozzle corresponding to the ink chamber, as shown by the broken line in the upper figure in FIG. 9. That is, the driving pulse P0 is to add reaction so that a large negative pressure is generated when the capacity of the ink chamber is expanded with the application of the subsequent driving pulse P11 to the electrode of the ink chamber, to generate a negative pressure in the ink in the ink chamber.

Then, at the time t12 when the pressure of the ink in the ink chamber which became positive by start of the application of the driving pulse P0 to the electrode of the ink chamber exceeds the peak of the positive pressure and changes to decrease and returns to the normal pressure, the application of the driving pulse P0 is finished. Subsequently, at the time t13 immediately after that, application of the driving pulse P11 to the electrode of the ink chamber is started.

As a result, a large negative pressure is generated in the pressure of the ink in the ink chamber as a reaction to the change to the positive pressure by the application of the driving pulse P0. Moreover, at the time t14 when the pressure of the ink in the ink chamber which became negative by the start of application of the driving pulse P11 to the electrode of the ink chamber exceeds a peak A of the negative pressure and changes to increase and exceeds the normal pressure and reaches a peak B of the positive pressure, the application of the driving pulse P11 is finished. As a result, discharge of the ink is started.

As described above, prior to application of the driving pulse P11 with a negative voltage (−VA) to the electrode of the ink chamber at the time t13, by applying the driving pulse P0 with the positive voltage (VA) to the electrode of the ink chamber for a period from the time t11 to t12 described above, the peak A of the negative pressure generated in the ink in the ink chamber is increased. Therefore, at the time t13 and after, when the pressure of the ink in the ink chamber having exceeded the peak A of the negative pressure changes to increase and changes to the positive pressure side after the normal pressure, as a reaction to the increase of the peak A of the negative pressure, a degree of the increase of the ink pressure becomes larger than the case that the driving pulse P0 is not applied in advance. Therefore, the peak B of the positive pressure of the ink pressure coming at the time t14 becomes high, and a discharge performance of the ink is improved.

Subsequently, at the time t15 when the pressure of the ink in the ink chamber changes to decrease and returns to the normal pressure by the negative pressure generated in the ink chamber by discharge of the ink, application of the driving pulse P12 to the electrode of the ink chamber is started. As a result, the degree of pressure reduction in the ink chamber is amplified.

An ink droplet at a point of time when the decreasing pressure of the ink in the ink chamber becomes a peak C of the negative pressure has a shape in which a tail portion continues to an elliptic head portion with a slightly swollen tip end as illustrated as a droplet shape 145 in a lower figure in FIG. 9. When this droplet shape 145 is compared with a droplet shape 141 illustrated in the lower figure in FIG. 8 at a corresponding point of time when the ink is discharged by the driving signal with the normal waveform in the lower figure in FIG. 8, swelling of the head portion is thinner in the satellite measure waveform than in the normal waveform. That is caused by an increase of a force to withdraw the ink into the ink chamber after start of the ink discharge. As a result, generation of a satellite at ink discharge is suppressed, and deterioration of a printing quality or stain on the device can be suppressed.

Moreover, even if the degree of reduction of the ink pressure is amplified by the application of the driving pulse P12, since the peak A of the negative pressure and the subsequent peak B of the positive pressure of the ink pressure are kept to be increased by the application of the driving pulse P0 and the subsequent application of the driving pulse P11 in the previous stage, the ink can be discharged properly.

After the start of the application of the driving pulse P12 to the electrode of the ink chamber, at time t17 immediately after the time t16 when the pressure of the ink in the ink chamber exceeds the peak C of the negative pressure and changes to increase and returns to the normal pressure, application of the driving pulse P13 to the electrode of the ink chamber is started. By this application of the driving pulse P13, meniscus vibration of the ink occurs once in the nozzle corresponding to the ink chamber. That is, ink is not discharged from the nozzle by the application of the driving pulse P13.

An ink droplet at a point of time when the increasing pressure of the ink in the ink chamber reaches a peak D of the positive pressure is illustrated as a droplet shape 146 in the lower figure in FIG. 9. When this droplet shape 146 is compared with the droplet shape 142 illustrated in the lower figure in FIG. 8 at the corresponding point of time when the ink is discharged by the driving signal by the normal waveform in the upper figure in FIG. 8, the satellite measure waveform has a thickness of the tail portion thinner than that of the normal waveform. That is because the tail of the ink thinned by the increase in the ink withdrawing force into the ink chamber after the start of the ink discharge is further extended after that. Moreover, as the application of the driving pulse P13 is finished at the time t18 after 0.6 AL has elapsed since the start of the application of the driving pulse P13, timing at which the pressure of the ink in the ink chamber having exceeded the peak D of the positive pressure and changed to decrease returns to the normal pressure is quickened. As a result, a fluctuation period of the ink pressure in which amplitude of the fluctuation is increased by the increase of the peak C of the negative pressure by the application of the driving pulse P12 is reduced, and start of the subsequent ink discharge operation can be quickened.

An ink droplet shape after the application of the driving pulse P13 in the driving signal of the satellite measure waveform is finished is illustrated as a droplet shape 147 in the lower figure in FIG. 9. When this droplet shape 147 is compared with the droplet shape 143 illustrated in the lower figure in FIG. 8 at the corresponding point of time when the ink is discharged by the driving signal by the normal waveform in the upper figure in FIG. 8, the thickness of the tail portion of the satellite measure waveform is obviously smaller than that of the normal waveform. That is also because of the increase in the ink withdrawing force into the ink chamber after the start of the ink discharge. As the thickness of the tail portion of the droplet of the ink becomes smaller as above, generation of a satellite after that is suppressed. More specifically, since the tail portion of the ink droplet becomes thinner, a liquid amount of the ink which becomes a satellite decreases, and a grain diameter of the satellite generated by division of the tail portion becomes smaller. Therefore, presence of the satellite on a recording sheet becomes inconspicuous, and suppression of generation of a satellite can be felt visually.

At Step S230, the CPU 81 performs printing at 300 dpi by discharging the ink in black (K) alternately from the upstream-side nozzle or the downstream-side nozzle by using the above described satellite measure waveform so that the ink is discharged alternately by each row of the two nozzle rows arranged in the inkjet heads 110*a* to 110*f* for each pixel row on the sheet P on which the printing is to be performed.

Figure 10A:
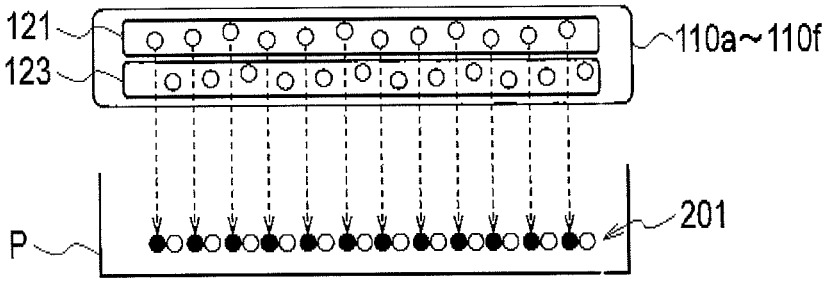
FIG. 10A is an explanatory diagram illustrating a discharge state when the ink is discharged from an upstream side nozzle in an ink discharge state in printing in a low resolution mode.
Figure 10B:
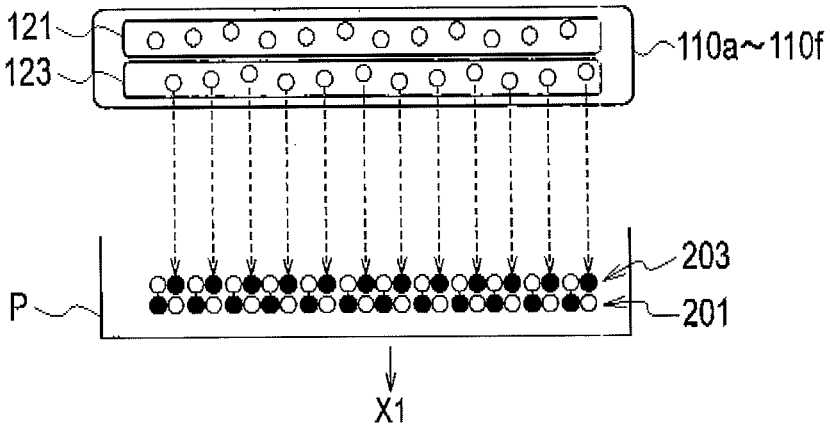
FIG. 10B is an explanatory diagram illustrating a discharge state when the ink is discharged from a downstream side nozzle in the ink discharge state illustrated in FIG. 10A.
Figure 10C:
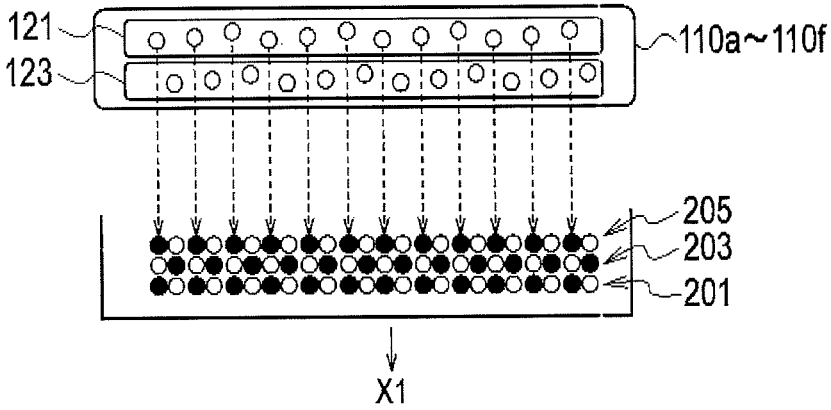
FIG. 10C is an explanatory diagram illustrating a discharge state when the ink is discharged from the upstream side nozzle in the ink discharge state illustrated in FIG. 10B.

FIGS. 10A to 10C are diagrams for explaining a discharge state of the ink when printing is performed in the low resolution mode (300 dpi) at Step S220 or S230. FIG. 10A is a diagram for explaining the discharge state when the ink is discharged from the upstream-side nozzle. FIG. 10B is a diagram for explaining the discharge state when the ink is discharged from the downstream-side nozzle. FIG. 10C is a diagram for explaining the discharge state when the ink is discharged from the upstream-side nozzle. FIGS. 10A to 10C schematically illustrate each of the nozzles and the sheet P, and here, it is assumed for convenience of explanation that printing is performed by one inkjet head on the sheet P.

As illustrated in FIG. 10A, when the low resolution mode (300 dpi) is set, the CPU 81 has the ink discharged from either one of the nozzle rows 121 and 123 arranged in the inkjet heads 110*a* to 110*f*. In this embodiment, first, the ink in black (K) is discharged from the upstream-side nozzle row 121 to a pixel row 201 on the sheet P to be printed so that the printing is performed on the sheet P at 300 dpi.

Then, as illustrated in FIG. 10B, after the sheet P is transferred in an X1 direction for the subsequent discharging timing portion, the ink in black (K) is discharged to a pixel row 203 on the downstream side of the pixel row 201 in the transfer direction from the nozzle row 123 on the downstream side with longer elapsed time from the closest point of time of discharge so that the printing is performed on the sheet P at 300 dpi.

Moreover, as illustrated in FIG. 10C, after the sheet P is transferred in the X1 direction for the subsequent discharging timing portion, the ink in black (K) is discharged to a pixel row 205 on the downstream side of the pixel row 203 in the transfer direction from the nozzle row 121 on the upstream side with longer elapsed time from the closest point of time of discharge so that the printing is performed on the sheet P at 300 dpi.

As described above, when the low resolution mode (300 dpi) is set, the CPU 81 has the ink in black (K) discharged from each nozzle row in order with the longer elapsed time from the closest point of time of discharge alternately from the nozzle row 121 on the upstream side or the nozzle row 123 on the downstream side, in the nozzle rows 121 and 123 arranged in the inkjet heads 110*a* to 110*f*, for each pixel row on the sheet P to be printed, and the printing is performed at 300 dpi.

Figure 11A:
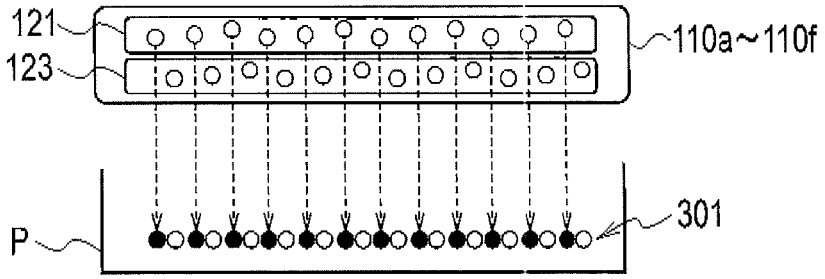
FIG. 11A is an explanatory diagram illustrating a discharge state when the ink is discharged from the upstream side nozzle in an ink discharge state in printing in a high resolution mode.
Figure 11B:
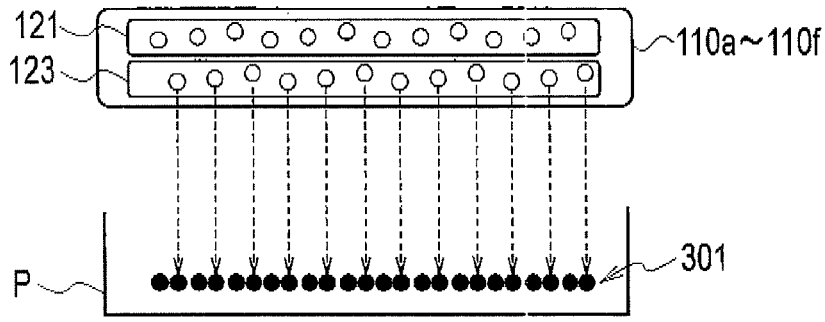
FIG. 11B is an explanatory diagram illustrating a discharge state when the ink is discharged from the downstream side nozzle in the ink discharge state illustrated in FIG. 11A.
Figure 11C:
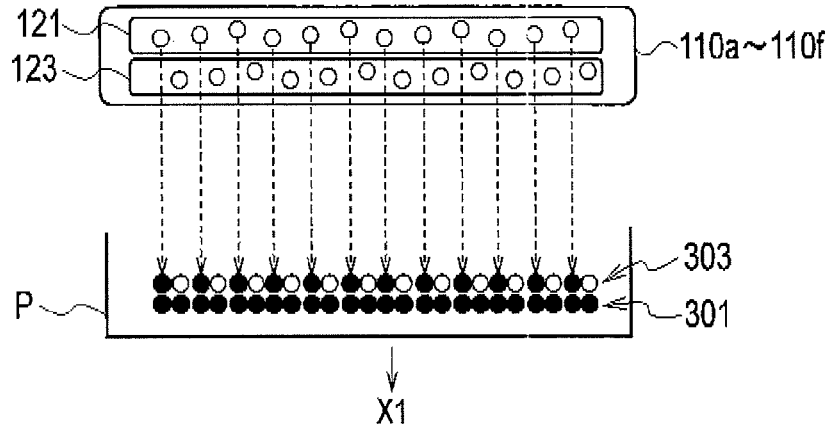
FIG. 11C is an explanatory diagram illustrating a discharge state when the ink is discharged from the upstream side nozzle in the ink discharge state illustrated in FIG. 11B.
Figure 11D:
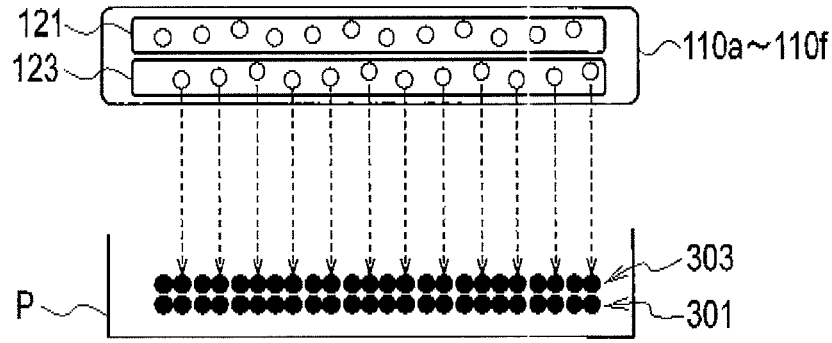
FIG. 11D is an explanatory diagram illustrating a discharge state when the ink is discharged from the downstream side nozzle in the ink discharge state illustrated in FIG. 11C.

FIGS. 11A to 11D are diagrams for explaining a discharge state of the ink of printing in the high resolution mode (600 dpi) at Step S140 for comparison. FIG. 11A is a diagram for explaining the discharge state when the ink is discharged from the upstream-side nozzle. FIG. 11B is a diagram for explaining the discharge state when the ink is discharged from the downstream-side nozzle. FIG. 11C is a diagram for explaining the discharge state when the ink is discharged from the upstream-side nozzle. FIG. 11D is a diagram for explaining the discharge state when the ink is discharged from the downstream-side nozzle.

As illustrated in FIG. 11A, when the high resolution mode (600 dpi) is set, the CPU 81 has the ink discharged from both the nozzle rows 121 and 123 arranged in the inkjet heads 110*a* to 110*f* in one pixel row on the sheet P. Here, first, the ink in black (K) is discharged from the upstream-side nozzle row 121 to a pixel row 301 on the sheet P to be printed.

Then, as illustrated in FIG. 11B, the sheet P is transferred, and when the downstream-side nozzle row 123 is located above the pixel row 301 on the sheet P to be printed, the ink in black (K) is discharged from the downstream-side nozzle 123 to the pixel row 301 so that the printing is performed on the sheet P at 600 dpi.

Moreover, as illustrated in FIG. 11C, the sheet P is transferred in the X1 direction for the subsequent discharging timing portion, and when the upstream-side nozzle row 121 is located above a pixel row 303 on the downstream side of the pixel row 301 in the transfer direction, the ink in black (K) is discharged from the upstream-side nozzle row 121 to the pixel row 303.

Then, as illustrated in FIG. 11D, the sheet P is transferred, and when the downstream-side nozzle row 123 is located above the pixel row 303 on the sheet P to be printed, the ink in black (K) is discharged from the downstream-side nozzle row 123 to the pixel row 303 so that the printing is performed on the sheet P at 600 dpi.

As described above, when printing is being made in the low resolution mode (300 dpi) illustrated in FIGS. 10A to 10C, power consumption can be reduced as compared with the printing in the high resolution mode (600 dpi) illustrated in FIGS. 11A to 11D, and since the number of dots discharged per unit area is small for a portion by which the dots are fewer, there are fewer satellites accompanying the ink droplets, and a favorable printing image can be obtained. When printing is performed in the low resolution mode (300 dpi), the number of drops per pixel may be increased as compared with the printing in the high resolution mode (600 dpi) in order to improve an image quality.

Moreover, since the ink in black (K) is discharged alternately from the upstream-side nozzle row 121 or the downstream-side nozzle row 123, a heat generation amount is smaller than that in printing in the high resolution mode (600 dpi). Thus, a driving period which is a period of printing on the sheet P can be reduced. More specifically, if printing is being performed in the high resolution mode (600 dpi), since the heat generation amount is large, an ink temperature can easily rise. Thus, the sheets P need to be transferred for printing at a predetermined temporal interval so that the ink temperature does not rise excessively.

In the inkjet printer 1, since the ink in black (K) is discharged alternately from the upstream-side nozzle row 121 or the downstream-side nozzle row 123, the heat generation amount is small and the ink temperature does not rise easily. Thus, the interval of transferring the sheets P can be reduced, and the driving period can be reduced. Moreover, as compared with the printing only by either one of the upstream-side nozzle row 121 and the downstream-side nozzle row 123, the heat generation amount is smaller, and the ink temperature does not rise easily. Thus, a period in which the sheet P is printed can be quickened.

In this embodiment, the inkjet printer 1 provided with the inkjet heads 110, 112, and 114 each having nozzles arranged in two rows is explained as an example, but the number of nozzle rows is not limited to two but may be three or more.

For example, if a nozzle row at an intermediate position is provided between the nozzle row 121 on the upstream side and the nozzle row 123 on the downstream side, it may be so configured that, after the ink in black (K) is discharged from the nozzle row 121 on the upstream side and the sheet P is transferred for the subsequent discharging timing, the ink in black (K) is discharged from the nozzle row at the intermediate position with the long elapsed time from the closest point of time of discharge and after the sheet P is further transferred for the subsequent discharging timing, the ink in black (K) is discharged from the nozzle row 123 on the downstream side with the long elapsed time from the closest point of time of discharge so that the printing is performed on the sheet P at 300 dpi. As a result, even if there are three or more nozzle rows, the ink can be discharged by each row in order of the nozzle rows.

Moreover, if there are three or more nozzle rows, the discharging timing of the inkjet heads is controlled so that the ink is discharged by each row in order from the nozzle row with the longer elapsed time from the closest point of time of discharge in the three nozzle rows for each pixel row on the sheet P to be printed, here, but this is not limiting.

The discharging timing of the inkjet head may be so controlled that the ink is discharged by each row in order in the two nozzle rows of the three nozzle rows for each pixel row on the sheet P to be printed.

For example, if the nozzle row on the upstream side, the nozzle row at the intermediate position, and the nozzle row on the downstream side are provided, after the ink in black (K) is discharged from the nozzle row on the upstream side and the sheet P is transferred for the subsequent discharging timing, the ink in black (K) is discharged from the nozzle row at the intermediate position and the sheet P is further transferred for the subsequent discharging timing, and then, the ink in black (K) is discharged from the nozzle row on the upstream side. That is, the discharging timing of the inkjet heads is controlled without using the nozzle row on the downstream side.

As a result, for example, if ink clogging or the like of the nozzle row on the downstream side occurs, the printing can be continued by discharging the ink from the remaining nozzle rows.

Moreover, the discharging timing of the inkjet heads may be controlled such that a thermometer for measuring an ink temperature is provided for each nozzle row, and the ink is continuously discharged from one nozzle row in the three nozzle rows within a range in which the ink temperature measured by the thermometer does not exceed a predetermined threshold value for each pixel row on the sheet P on which printing is to be performed, and if the ink temperature measured by the thermometer exceeds the predetermined threshold value, the ink is discharged in order from the other nozzle rows.

For example, if the nozzle row on the upstream side, the nozzle row at the intermediate position, and the nozzle row on the downstream side are provided, after the ink in black (K) is discharged from the nozzle row on the upstream side and the sheet P is transferred for the subsequent discharging timing, if the ink temperature corresponding to the nozzle row on the upstream side does not exceed the predetermined threshold value, the ink in black (K) is continuously discharged from the nozzle row on the upstream side.

On the other hand, if the ink temperature corresponding to the nozzle row on the upstream side exceeds the predetermined threshold value, the ink in black (K) is discharged from the nozzle row at the intermediate position.

Then, after the sheet P is transferred for the subsequent discharging timing, if the ink temperature corresponding to the nozzle row at the intermediate position does not exceed the predetermined threshold value, the ink in black (K) is continuously discharged from the nozzle row at the intermediate position.

On the other hand, if the ink temperature corresponding to the nozzle row at the intermediate position exceeds the predetermined threshold value, the ink in black (K) is discharged from the nozzle row on the downstream side.

Then, after the sheet P is transferred for the subsequent discharging timing, if the ink temperature corresponding to the nozzle row on the downstream side does not exceed the predetermined threshold value, the ink in black (K) is continuously discharged from the nozzle row on the downstream side.

On the other hand, if the ink temperature corresponding to the nozzle row on the downstream side exceeds the predetermined threshold value, the ink in black (K) is discharged from the nozzle row on the upstream side. As described above, the discharging timing of the inkjet heads may be controlled such that the ink is continuously discharged from one nozzle row in the three nozzle rows within the range in which the ink temperature measured by the thermometer does not exceed the predetermined threshold value.

Second Embodiment

In the first embodiment, the inkjet printer 1 which calculates the influence E on the basis of the obtained gap influence Eg, temperature influence Et, and image position influence E1 is explained as an example.

In this embodiment, moreover, the inkjet printer 1 which calculates the influence E on the basis of an applicable image influence will be described as an example.

Figure 12:
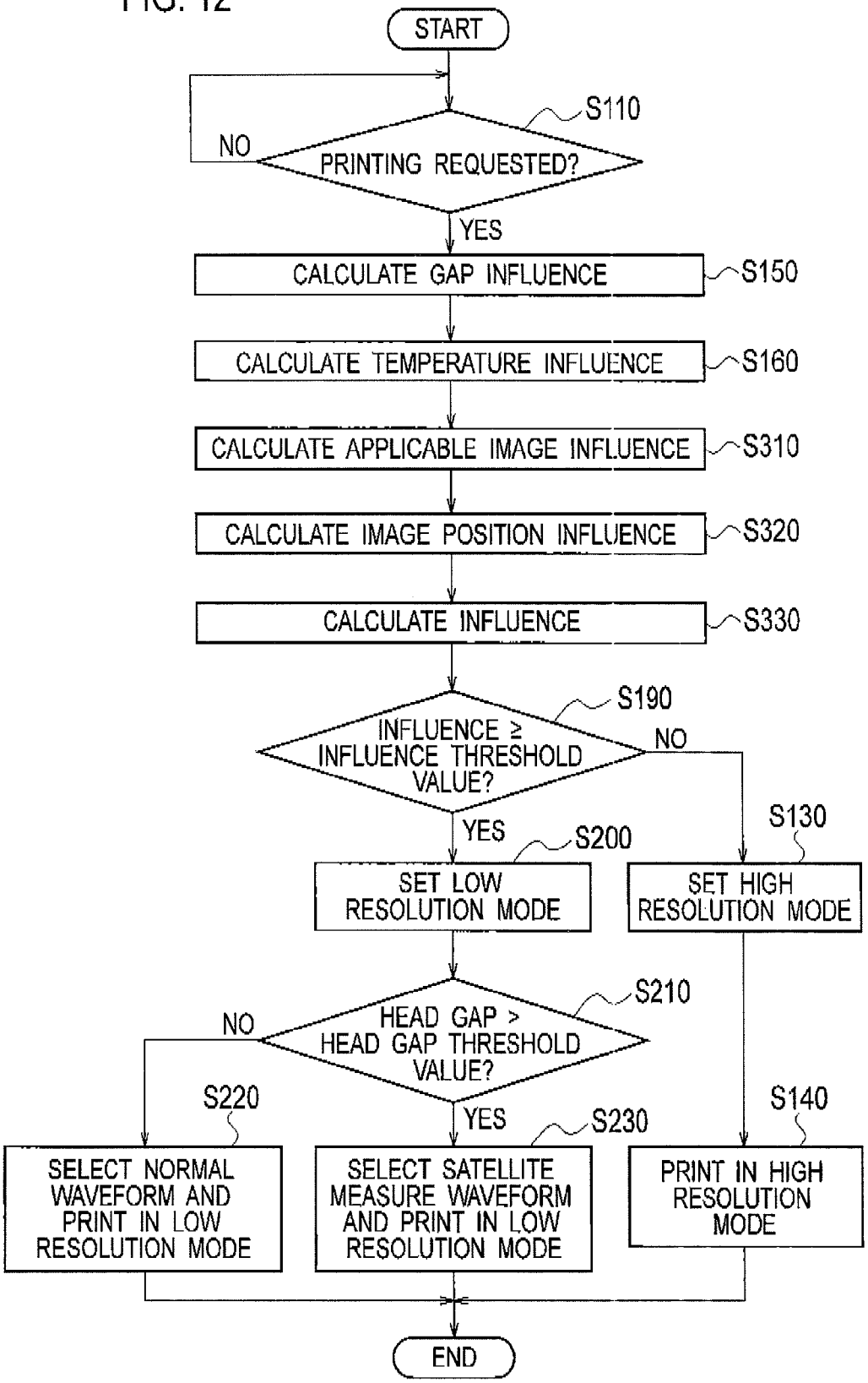
FIG. 12 is a flowchart illustrating a processing procedure of an inkjet printer according to a second embodiment of the present invention.

FIG. 12 is a flowchart illustrating a processing procedure of the inkjet printer 1. In processing steps illustrated in the flowchart illustrated in FIG. 12, the same processing steps as those in the flowchart illustrated in FIG. 6 are given the same step numbers and the explanation will be omitted, and only the processing steps specific to this embodiment will be explained.

As illustrated in FIG. 12, the influence calculation portion 81*a* calculates the temperature influence Et (S160) and then, calculates an applicable image influence Ep (S310).

FIG. 13A is a diagram illustrating an example of an applicable image table indicating a relationship between presence of an applicable image and the applicable image influence Ep, stored in the ROM 82 of the control portion 80 provided in the inkjet printer 1.

As illustrated in FIG. 13A, a column name "applicable image" (reference numeral 181) and name "applicable image influence Ep" (reference numeral 182) are associated with each other and stored as the applicable image table. Here, the applicable image 181 indicates a special image or a framed image which has a great influence of image deterioration by generation of a satellite, for example, as described above. If this applicable image is included, an influence on the satellite is great. Thus, the association is made such that a value of the applicable image influence Ep (reference numeral 182) indicating a degree of an influence of satellite generation becomes higher when presence of the applicable image 181 is "yes" rather than "no".

Thus, the influence calculation portion 81*a* determines whether or not the image data of the printing job contains the applicable image. The influence calculation portion 81*a* calculates the applicable image influence Ep on the basis of this determination result and the applicable image table stored in the ROM 82.

Returning to FIG. 12, the influence calculation portion 81*a* calculates the image position influence E1 (S330).

FIG. 13B is a diagram illustrating an example of the image position table indicating a relationship between the image position and the image position influence E1.

As illustrated in FIG. 13B, a column name "image position" (reference numeral 157) and name "image position influence E1" (reference numeral 158) are associated with each other and stored as the image position table. Since an air flow going around the sheet P is generated toward a direction of an end portion which is the closest on the sheet P, the closer to the end portion of the sheet P the image to be printed is, the greater the influence of a satellite is.

Thus, the image position influence E1 (reference numeral: 158) is determined whether the image is located in the center region or in the peripheral region. Moreover, in the image position table stored in the ROM 82 provided in the inkjet printer 1, if the applicable image influence Ep is "1", that is, if the applicable image is not included in the image data of the printing job, the influence of a satellite is small. Thus, whether the image is in the applicable region or not, association is set so that the value of the image position influence E1 is "1".

The influence calculation portion 81*a* obtains a coordinate of the applicable image included in the printing job and determines whether the applicable image is in the center region 161 or in the peripheral region 162. The influence calculation portion 81*a* calculates the image position influence E1 on the basis of this determination result, the value of the applicable image influence Ep and the image position table stored in the ROM 82.

Subsequently, the influence calculation portion 81*a* calculates the influence (S330). More specifically, the influence calculation portion 81*a* calculates the influence E by using the following (formula 2) on the basis of the obtained gap influence Eg, temperature influence Et, applicable image influence Ep, and image position influence E1.

$$\text{Influence } E = Eg \times Et \times Ep \times E1 \quad \text{(formula 2).}$$

FIG. 14 is a diagram illustrating a calculation example of the influence E calculated by the CPU 81 of the inkjet printer 1.

As illustrated in FIG. 14, by substituting the obtained gap influence Eg, temperature influence Et, applicable image influence Ep, and image position influence E1 in the above described (formula 2), the influence E is calculated.

As the influence threshold value Eth, an appropriate value needs to be set in advance by a user and the like. In this embodiment, the influence threshold value Eth is set to "2.0".

That is, since the influence E indicated at 174 and 176 illustrated in FIG. 14 is smaller than "2.0" which is the value of the influence threshold value Eth, the CPU 81 determines that the influence E is less than the influence threshold value Eth. Since the influence E indicated at 175 illustrated in FIG. 14 is larger than "2.0" which is the value of the influence threshold value Eth, the CPU 81 determines that the influence E is not less than the influence threshold value Eth.

As described above, according to the inkjet printer 1, the influence E is calculated on the basis of the gap influence Eg, the temperature influence Et, the applicable image influence Ep, and the image position influence E1, the influence E including the applicable image influence Ep can be calculated with higher accuracy than the influence E in the first embodiment.

In the first and second embodiments, the line-type inkjet printer which has inkjet heads aligned in a direction (main-scanning direction) orthogonal to the sheet transfer direction and performs printing on a sheet transferred on the transfer path by discharging the ink from the nozzle of the inkjet heads on the basis of the image data is explained as an example, but this is not limiting.

The inkjet printer may be a serial-type inkjet printer which has an inkjet head moving in the direction (main-scanning direction) orthogonal to the sheet transfer direction and performs printing on the transferred sheet by discharging the ink from the nozzle of the inkjet head on the basis of the image data.

In the serial-type inkjet printer, a plurality of nozzle rows are aligned on one inkjet head moving in the direction (main-scanning direction) orthogonal to the sheet transfer direction so as to be in parallel with the sheet transfer direction (sub-scanning direction). In the plurality of nozzle rows, positions of the nozzles in the sub-scanning direction are provided by shifting from each other. When the transferred sheet stands still, the ink is discharged from at least one nozzle row in the plurality of nozzle rows to the sheet while the inkjet head is moved in the main-scanning direction.

In the case of such serial-type inkjet printer, too, the discharging timing of the inkjet head is controlled such that the ink is discharged by each row alternately in the plurality of nozzle rows when the influence calculated by the influence calculation portion 81*a* exceeds the predetermined threshold value. Thus, appropriate resolution according to the degree of influence of generation of a satellite can be selected, and generation of the satellite can be reduced, and printing can be performed without deteriorating productivity.

That is, it is only necessary to be configured that the inkjet head has a plurality of nozzle rows aligned in parallel, and the ink is discharged from at least one nozzle row in the plurality of nozzle rows while the inkjet head is relatively moving with respect to the sheet P.

What is claimed is:

1. An inkjet printer that has an inkjet head in which a plurality of nozzle rows that discharge ink are aligned in parallel, and performs printing on a sheet while switching resolution, by discharging ink from a nozzle row selected from the plurality of nozzle rows while the inkjet head and the sheet are relatively moved, the inkjet printer comprising:

an influence calculator that calculates an influence indicating a degree of an influence of generation of a satellite on the sheet on the basis of a printing condition, before printing; and a controller that controls the inkjet head so that (i) one pixel row is formed by discharging the ink from at least two nozzle rows among the plurality of nozzle rows when the influence calculated by the influence calculator does not exceed a predetermined threshold value, and (ii) one pixel row is formed by discharging the ink from one nozzle row among the plurality of nozzle rows when the influence calculated by the influence calculator meets or exceeds the predetermined threshold value, wherein the controller controls discharging timing of the inkjet head so that the ink is discharged by each row in a decreasing order of elapsed time from a nozzle row with the longest elapsed time since ink was discharged therefrom for each pixel row on the sheet on which printing is to be performed, when the influence calculated by the influence calculator exceeds the predetermined threshold value.

2. The inkjet printer according to claim 1, wherein the controller controls the discharging timing of the inkjet head so that the ink is discharged per row by each row of the plurality of the nozzle rows for each pixel row on the sheet on which printing is to be performed, when the influence calculated by the influence calculation portion exceeds the predetermined threshold value.

3. The inkjet printer according to claim 1, wherein the influence calculator calculates an influence indicating a degree of an influence of generation of a satellite, on the basis of presence of an image with a great influence on image deterioration caused by the generation of a satellite or on the basis of an image position.

4. The inkjet printer according to claim 1, wherein the inkjet head has an ink chamber communicating with a nozzle and discharges the ink from the nozzle by changing a capacity of the ink chamber on the basis of a supplied driving signal; and the controller supplies the driving signal with a driving waveform to the inkjet head so as to reduce an ink amount accompanying major ink droplets discharged from the nozzle.

5. The inkjet printer according to claim 4, wherein the controller supplies the driving signal with a driving waveform to the inkjet head so as to reduce the ink amount accompanying the major ink droplets discharged from the nozzle in accordance with a gap between the inkjet head and a transfer portion for transferring the sheet.

6. The inkjet printer according to claim 4, wherein the controller supplies the driving signal of such a degree that the ink is not discharged from a nozzle row other than the nozzle row discharging the ink of the plurality of nozzle rows of the inkjet head.

7. The inkjet printer according to claim 1, wherein the influence calculator calculates the influence based upon a sheet thickness, an ink viscosity, and a position of an image to be printed with respect to an edge of the sheet.

8. The inkjet printer according to claim 1, wherein, when the influence calculated by the influence calculator exceeds the predetermined threshold and a head gap exceeds a head gap threshold value, a first driving signal waveform is selected and printing in a low resolution mode is performed, and when the influence calculated by the influence calculator exceeds the predetermined threshold and the head gap does not exceed the head gap threshold value, a second driving signal waveform is selected and printing in a low resolution mode is performed.

9. The inkjet printer according to claim 1, wherein the influence calculator calculates the influence based upon an image type, a sheet thickness, an ink viscosity, and a position of the image to be printed with respect to an edge of the sheet.

10. The inkjet printer according to claim 1, wherein a number of drops per pixel, when the one pixel row is formed by discharging the ink from the one nozzle row, is larger than a number of drops per pixel, when the one pixel row is formed by discharging the ink from the at least two nozzle rows.

11. An inkjet printer that has an inkjet head in which a plurality of nozzle rows, that discharge ink, are aligned in parallel, and performs printing on a sheet while switching resolution, by discharging ink from a nozzle row selected from the plurality of nozzle rows while the inkjet head and the sheet are relatively moved, the inkjet printer comprising:

an influence calculator that calculates an influence indicating a degree of an influence of generation of a satellite on the basis of a printing condition, and a controller that controls discharge timing of the inkjet head so that the ink is alternately discharged by each row of the plurality of nozzle rows for each pixel row on the sheet on which printing is to be performed, when the influence calculated by the influence calculator exceeds a predetermined threshold value, wherein the inkjet head comprises an ink chamber communicating with a nozzle and discharging ink from the nozzle by changing a capacity of the ink chamber on the basis of a supplied driving signal, and the controller supplies the driving signal to the inkjet head with a driving waveform so as to reduce an ink amount accompanying major ink droplets discharged from the nozzle from an ink amount produced using a normal waveform, and by increasing a force from a predetermined force to withdraw the ink into the ink chamber.

12. The inkjet printer according to claim 11, wherein the influence calculator calculates the influence based upon a sheet thickness, an ink viscosity, and a position of an image to be printed with respect to an edge of the sheet.

13. The inkjet printer according to claim 11, wherein, when the influence calculated by the influence calculator exceeds the predetermined threshold and a head gap exceeds a head gap threshold value, a first driving signal waveform is selected and printing in a low resolution mode is performed, and when the influence calculated by the influence calculator exceeds the predetermined threshold and the head gap does not exceed the head gap threshold value, a second driving signal waveform is selected and printing in a low resolution mode is performed.

14. The inkjet printer according to claim 11, wherein the influence calculator calculates the influence based upon an image type, sheet thickness, ink viscosity, and a position of the image to be printed with respect to an edge of the sheet.

15. The inkjet printer according to claim 11, said controller increasing the force to withdraw the ink into the chamber after discharge of ink droplets from the nozzle has started.

16. An inkjet printer that has an inkjet head in which a plurality of nozzle rows that discharge ink are aligned in parallel, and performs printing on a sheet while switching resolution, by discharging ink from a nozzle row selected from the plurality of nozzle rows while the inkjet head and the sheet are relatively moved, the inkjet printer comprising:

an influence calculator that calculates an influence indicating a degree of an influence of generation of a satellite on the sheet on the basis of a printing condition, before printing; and a controller that controls the inkjet head so that (i) one pixel row is formed by discharging the ink from at least two nozzle rows among the plurality of nozzle rows when the influence calculated by the influence calculator does not exceed a predetermined threshold value, and (ii) one pixel row is formed by discharging the ink from one nozzle row among the plurality of nozzle rows when the influence calculated by the influence calculator meets or exceeds the predetermined threshold value, wherein, when the influence calculated by the influence calculator exceeds the predetermined threshold and a head gap exceeds a head gap threshold value, a first driving signal waveform is selected and printing in a low resolution mode is performed, and when the influence calculated by the influence calculator exceeds the predetermined threshold and the head gap does not exceed the head gap threshold value, a second driving signal waveform is selected and printing in a low resolution mode is performed.

17. An inkjet printer that has an inkjet head in which a plurality of nozzle rows that discharge ink are aligned in parallel, and performs printing on a sheet while switching resolution, by discharging ink from a nozzle row selected from the plurality of nozzle rows while the inkjet head and the sheet are relatively moved, the inkjet printer comprising:

an influence calculator that calculates an influence indicating a degree of an influence of generation of a satellite on the sheet on the basis of a printing condition, before printing; and a controller that controls the inkjet head so that (i) one pixel row is formed by discharging the ink from at least two nozzle rows among the plurality of nozzle rows when the influence calculated by the influence calculator does not exceed a predetermined threshold value, and (ii) one pixel row is formed by discharging the ink from one nozzle row among the plurality of nozzle rows when the influence calculated by the influence calculator meets or exceeds the predetermined threshold value, wherein a number of drops per pixel, when the one pixel row is formed by discharging the ink from the one nozzle row, is larger than a number of drops per pixel, when the one pixel row is formed by discharging the ink from the at least two nozzle rows.

* * * * *